United States Patent [19]

Okuda

[11] Patent Number: 4,951,625

[45] Date of Patent: Aug. 28, 1990

[54] INTERNAL COMBUSTION ENGINE STOP DEVICE

[75] Inventor: Hiroshi Okuda, Himeji, Japan

[73] Assignee: Mitsubishi Denki Kabushiki Kaisha, Tokyo, Japan

[21] Appl. No.: 432,014

[22] Filed: Nov. 6, 1989

[30] Foreign Application Priority Data

May 12, 1988 [JP] Japan ..... 63-63777[U]

[51] Int. Cl.[5] ..... F02P 3/06; F02P 11/00; F02B 77/08

[52] U.S. Cl. ..... 123/198 DC; 123/599; 123/604

[58] Field of Search ..... 123/198 DC, 335, 599, 123/602, 604, 605, 625, 630, 632

[56] References Cited

U.S. PATENT DOCUMENTS

| | | | |
|---|---|---|---|
| 3,960,128 | 6/1976 | Anderson et al. | 123/198 DC |
| 4,073,279 | 2/1978 | Fox | 123/198 DC |
| 4,193,385 | 3/1980 | Katsumata et al. | 123/198 DC |
| 4,436,076 | 3/1984 | Piteo | 123/198 DC X |
| 4,565,179 | 1/1986 | Nytomt et al. | 123/198 DC X |

FOREIGN PATENT DOCUMENTS

| | | | |
|---|---|---|---|
| 0148969 | 11/1980 | Japan | 123/198 DC |
| 0217777 | 12/1983 | Japan | 123/198 DC |
| 0040871 | 12/1985 | Japan . | |

*Primary Examiner*—Willis R. Wolfe

*Attorney, Agent, or Firm*—Sughrue, Mion, Zinn, Macpeak and Seas

[57] ABSTRACT

An internal combustion engine stop device comprises a power generation winding for generating electric power corresponding to the rotation of an engine and charging a capacitor for an ignition winding; and a stop circuit for bringing the output of the power generation winding to a short-circuit state based on the actuation of the stop switch, wherein the stop switch is of a self-reset type, and wherein the stop circuit is constituted by a self-holding circuit for keeping the short-circuit state based on the actuation of the stop switch, and a delay circuit for actuating the self-holding circuit when a switched state of the stop switch is kept for a predetermined time.

1 Claim, 2 Drawing Sheets

INTERNAL COMBUSTION ENGINE STOP DEVICE

BACKGROUND OF THE INVENTION

1. Field of the Invention

The present invention relates to an internal combustion engine stop device having electrically self-holding function.

2. Discussion of Background

FIG. 2 is a schematic circuit diagram showing the structure of a conventional internal combustion engine stop device. In FIG. 2, reference numeral 1 designates a power generation winding which is driven by an engine (not shown) to generate an a.c. output. Reference numeral 2 designates a capacitor for an ignition winding, which is charged through a diode 3 by one of the polarity outputs of the a.c. output of the power generation winding 1. Reference numeral 4 designates the ignition winding whose secondary winding is connected to an ignition plug 5. Reference numeral 6 designates a signal winding which generates an ignition signal in synchronism with the rotation of the engine. The output of the signal winding is applied to the gate of a thyristor 8 through a diode 7. Reference numeral 9 designates a bias resistor which is connected between the gate and the cathode of the thyristor 8. Reference numeral 10 designates a diode which is connected in parallel with the primary winding of the ignition winding 4 to bypass the counter-electromotive force caused in the ignition coil 4.

Reference numeral 11 designates a self-reset type stop switch which has normally opened contacts. The switch has one terminal connected to a stop circuit 12 and the other terminal grounded. Reference numeral 13 designates a thyristor in the stop circuit 12, whose anode is connected to one end of the power generation winding 1, and whose cathode is grounded through a resistor 14 and a diode 15. The gate of the thyristor 13 is connected to the cathode of a diode 17 through a resistor 16. Between the gate and the cathode of the thyristor 13 is connected a resistor 18. Reference numerals 19 and 20 designate a diode and a capacitor, respectively, which are connected in series so as to be in parallel with the resistor 14. The junction between the diode 19 and the capacitor 20 is connected to the anode of the diode 17, and also connected to the one terminal of the stop switch through a diode 21 which is reversely connected. The junction between the capacitor 20 and the resistor 14 is connected to the one end of the power generation winding 1 through a diode 22.

In operation, when the engine rotates, the power generation winding 1 generates the a.c. output, and charges the capacitor 2 through the diode 3 by the one polarity output (b direction voltage). The signal winding 6 outputs the ignition signal corresponding to a predetermined ignition timing, thereby to cause the thyristor 8 to conduct. The conduction of the thyristor 8 discharges the charge stored in the capacitor 2 to the primary winding of the ignition coil 4, causing a high voltage to generate in the primary winding. As a result, spark discharge causes in the ignition plug 5.

During the normal operation of the engine, the stop switch 11 is opened, and the thyristor 13 in the stop circuit 12 does not conduct. As a result, the output of the power generation winding 1 is supplied to the capacitor 2 without being brought to a short-circuit state. In this way, the normal ignition operation is carried out.

When the stop switch 11 is closed, the other polarity output (a direction voltage) generated by the power generation winding 11 flows in the route of the stop switch 11, the diode 21, the capacitor 20, the diode 22 and the power generation winding 1, thereby charging the capacitor 20. When the power generation winding 1 generates the b direction voltage output, the charge stored in the capacitor 20 is charged in the route of the diode 17, the resistor 16, the part between the gate and the cathode of the thyristor 13, and the resistor 14, allowing the thyristor 13 to conduct. As a result, the b direction voltage generated by the power generation winding 1 is brought to a short-circuit stage through the thyristor 13, the resistor 14 and the diode 15. In this way, the b direction voltage of the generation winding 1 is not applied to the capacitor 2, causing the ignition operation to stop. The voltage which causes across the resistor 14 at the time of bringing the b direction voltage to the short-circuit stage charges the capacitor 20 through the diode 19, and the discharge as just mentioned is repeated. This allows the thyristor 13 to keep its conduction stage even if the stop switch 11 is opened. In this way, a misfire state continues until the engine has stopped.

In the conventional internal combustion engine stop device, the stop circuit 12 can actuate even if the time for the stop switch 11 to be in the closing state is very short. As a result, there is a possibility that the stop circuit 12 is actuated to stop the engine even when a use accidentally gets in touch with the stop switch 11 even for a moment or the contacts of the stop switch 11 contact with each other due to the vibration of the engine. This creates a problem in that the reliability of the stop operation is low.

SUMMARY OF THE INVENTION

It is an object of the present invention to solve the problem and to provide a new and improved internal combustion entine stop device capable of improving the reliability of the stop operation.

The foregoing and other objects of the present invention have been attained by providing an internal combustion engine stop device comprising a power generation winding for generating electric power corresponding to the rotation of an engine and charging a capacitor for an ignition winding; and a stop circuit for bringing the output of the power generation winding to a short-circuit state based on the actuation of the stop switch, wherein the stop switch is of a self-reset type, and wherein the stop circuit is constituted by a self-holding circuit for keeping the short-circuit state based on the actuation of the stop switch, and a delay circuit for actuating the self-holidng circuit when a switched state of the stop switch is kept for a predetermined time. As a result, even if a user accidentally gets in touch with the stop switch for a moment, or even if chattering causes in the stop switch, the presence of the delay circuit prevents the self-holding circuit from actuating provided that the switched state of the stop switch is kept for a very short time. In this way, the output generated by the power generation winding is not short-circuited, and the normal ignition operation is carried out.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
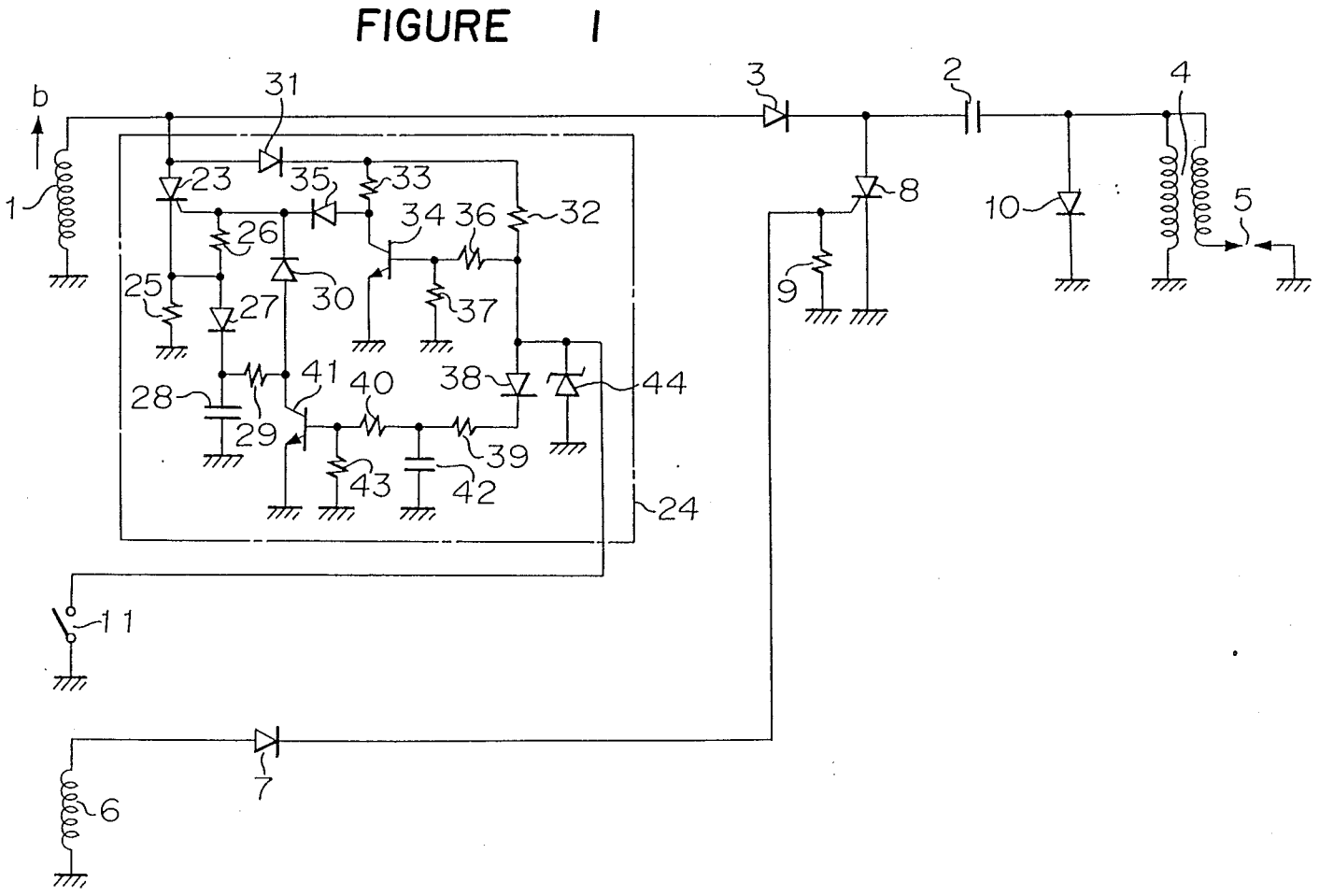
FIG. 1 is a schematic circuit diagram of the internal combustion engine stop device according to an embodiment of the present invention.
Figure 2:
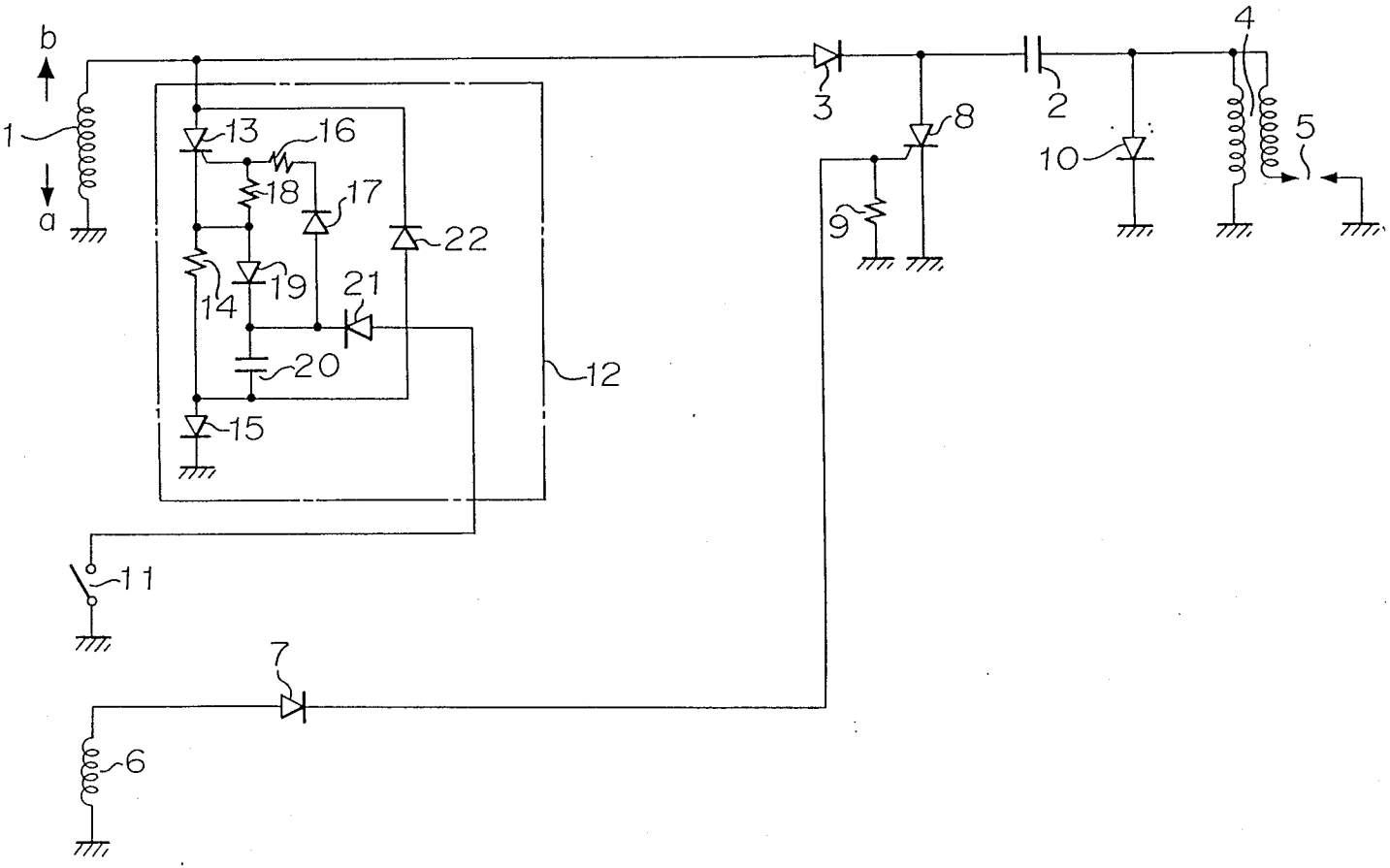
FIG. 2 is a schematic circuit diagram of a conventional internal combustion engine stop device.

Now, the present invention will be described in detail with reference to a preferred embodiment illustrated in the accompanying drawing. In FIG. 1, parts indicated by reference numerals 1 through 11 are the same as those of the conventional device as shown in FIG. 2. Explanation on such parts will be omitted for the sake of clarity. Reference numeral 23 designates a thyristor in a stop circuit 24, whose anode is connected to one end of the power generation winding 1, and whose cathode is grounded through a resistor 25. Between the gate and the cathode of the thyristor 23 is connected a resistor 26. A series combination of a diode 27 and a capacitor 28 is connected in parallel to the resistor 25. The junction between the diode 27 and the capacitor 28 is connected to the gate of the thyristor 23 through a resistor 29 and a diode 30. Reference numeral 31 and 32 designate a diode and a resistor, respectively, which are arranged between the one end of the power generation winding 1 and one terminal (non-grounded terminal) of the stop switch. The junction between the diode 31 and the resistor 32 is connected to the collector of a transistor 34 through a resistor 33. The collector of the transistor 34 is connected to the gate of the thyristor 23 through a diode 35. The base of the transistor 34 is connected to the one end of the stop switch 11 through a resistor 36, and also is grounded through a resistor 37. The emitter of the transistor 34 is grounded. The junction between the resistor 36 and the stop switch 11 is connected to the base of a transistor 41 through a diode 38, and resistors 39 and 40. The junction between the resistor 39 and the resistor 40 is grounded through a capacitor 42. The junction between the resistor 40 and the transistor 41 is grounded through a resistor 43. The collector of the transistor 41 is connected to the junction between the resistor 29 and the anode of the diode 30. The emitter of the transistor 41 is grounded. The diode 38, the resistors 39 and 40, the transistor 41, the capacitor 42 and the resistor 43 constitute the delay circuit according to the present invention. Reference numeral 44 designates a Zener diode which is connected between the conduction path from the resistor 32 to the stop switch 11, and ground.

Next, the operation of the internal combustion engine stop device having the structure described above will be explained. During the normal operation of the engine, the stop switch 11 is kept opened, and the small b direction voltage generated by the power generation winding 1 is applied to the base of the transistor 34 through the diode 31 and the resistors 32 and 36, causing the transistor 34 to conduct. As a result, the current which flows through the resistor 33 is bypassed through the transistor 34 to prevent the thyristor 23 from being triggered. At this time, the voltage across the Zener diode 44 charges the capacitor 42 through the resistor 39.

On the other hand, when the stop switch 11 is closed, the current which flows through the resistor 32 is bypassed to drive the transistor 34 to cutoff. The current which flows through the resistor 33 is applied to the gate of the thyristor 23 through the diode 35, allowing the thyristor 23 to conduct. As a result, the small b direction voltage generated by the power generation winding 1 is brought to a short-circuit state through the thyristor 23 and the resistor 25. At this time, the voltage across the resistor 25 charges the capacitor 28. After that, the charge stored in the capacitor 28 is supplied to the gate of the thyristor 23 through the resistor 29 and the diode 30 to keep the thyristor 23 in conduction like the conventional device. Keeping the thyristor 23 in conduction is held until the engine has stopped. In this way, closing the stop switch 11 allows the output of the power generation winding 1 to be self-held in such short-circuit state.

On the other hand, the capacitor 42 is charged when the stop switch is opened. This allows the transistor 41 to remain conducting even if the output by the power generation winding is bypassed through the stop switch 11 in the event that the time for the stop switch 11 to be in a closing state is very short. This is because that charge stored in the capacitor 42 is applied to the base of the transistor 41. As a result, the thyristor 23 is drive to conduction. Even if the capacitor 28 is charged, the charge stored in the capacitor 28 is charged through the transistor 41, which does not keep the thyristor 23 in conduction, and does not carry out the stop operation. In other words, unless the time for the stop switch 11 to be in a closing state exceeds the time required for the capacitor 42 to have discharged, the conduction of the thyristor 23 is not self-held. This allows the engine to be prevented from stopping even if a user accidentally gets in touch with the stop switch 11 for a moment or chattering occurs.

In addition, in the embodiment, the provision of the Zener diode 44 makes the discharge voltage to the capacitor 42 constant. This allows the operation time of the delay circuit to be made constant, and can lower the voltage applied to the opened contacts of the stop switch 11 during the operation of the engine in comparison with the conventional device. As a result, insulating properties of the stop switch 11 and the wiring can be improved. It is possible to overcome the problem wherein leak resistance having very small value occurs due to the presence of droplet, dust or the like between the contacts to make the stop circuit malfunction.

Although the explanation on the embodiment has been made with reference to the case wherein the contacts of the stop switch 11 are of a normally opened type, the stop switch according to the present invention is not limited to such type. As long as the self-holding circuit and the delay circuit take action by the actuation of the stop switch 11, a normally closed type stop switch can be also used to offer advantage similar to the embodiment.

In accordance with the present invention, only when the actuation of the self-reset type of stop switch is continued for a predetermined time, the self-holding circuit takes action. This structure can prevent the engine from stopping by accident when a user accidentally gets in touch with the stop switch for a moment or chattering occurs.

Obviously, numerous modifications and variations of the present invention are possible in light of the above teachings. It is therefore to be understood that within the scope of the appended claims, the invention may be practiced otherwise than as specifically described herein.

What is claimed is:

1. An internal combustion engine stop device comprising:

a power generation winding for generating electric power corresponding to the rotation of an engine and charging a capacitor for an ignition winding; and a stop circuit for bringing the output of the power generation winding to a short-circuit state based on the actuation of the stop switch, wherein the stop switch is of a self-reset type, and wherein the stop circuit is constituted by a self-holding circuit for keeping the short-circuit state based on the actuation of the stop switch, and a delay circuit for actuating the self-holding circuit when a switched state of the stop switch is kept for a predetermined time.

* * * * *